United States Patent [19]

Moriya et al.

[11] Patent Number: 4,795,283

[45] Date of Patent: Jan. 3, 1989

[54] PRINT HEAD FOR A DOT-PRINTER

[75] Inventors: Takashi Moriya, Tokyo; Masao Kunita, Saitama; Toshihiro Endo, Tokyo, all of Japan

[73] Assignee: Citizen Watch Co., Ltd., Tokyo, Japan

[21] Appl. No.: 107,361

[22] Filed: Oct. 9, 1987

[30] Foreign Application Priority Data

Oct. 14, 1986 [JP] Japan ..... 61-156076[U]
Oct. 25, 1986 [JP] Japan ..... 61-163884[U]

[51] Int. Cl.[4] ..... B41J 3/12
[52] U.S. Cl. ..... 400/124; 101/93.05
[58] Field of Search ..... 400/124; 101/93.05

[56] References Cited

U.S. PATENT DOCUMENTS 4,407,591 10/1983 Adamoli et al. ..... 400/124
4,447,166 5/1984 Ochiai ..... 400/124
4,555,192 11/1985 Ochiai ..... 400/124
4,561,790 12/1985 Evans et al. ..... 400/124
4,569,605 2/1986 Meier et al. ..... 400/124
4,613,246 9/1986 Sugiura ..... 400/124 X

FOREIGN PATENT DOCUMENTS 1332142 10/1973 United Kingdom ..... 400/124

*Primary Examiner*—Paul T. Sewell
*Attorney, Agent, or Firm*—Wenderoth, Lind & Ponack

[57] ABSTRACT

A print head for a dot-type printer has a nose having a wire point guide thereon and a plurality of print wires slidably guided in the wire point guide, and a nose base contacting surface thereon, a solenoid base having a magnetic system for moving the respective print wires selectively for causing the point ends of the wires to move outwardly from the wire point guide for printing on a platen, and a nose base having a nose contacting surface in opposed relation to the nose base contacting surface on the nose, and having a solenoid base contacting surface in opposed relation to the solenoid base and having a mounting device for mounting the print head on a carriage. A spacer is engaged between the nose base contacting surface and the nose contacting surface for adjusting the distance the wire ends extend from the front of the wire point guide, a further spacer is engaged between the solenoid base and the solenoid base contacting surface for adjusting the distance of the wire ends from the carriage, and a leaf spring is removably engaged between the nose and the nose base for holding the nose and the nose base together.

3 Claims, 5 Drawing Sheets

(a)

(b)

PRINT HEAD FOR A DOT-PRINTER

BACKGROUND OF THE INVENTION

1. Field of the Invention

The present invention relates to a print head of a dot-printer for printing letters on paper on a platen and more particularly to mechanism for adjusting print wire point ends which are slidably mounted on a nose and project from a wire point guide.

2. Description of the Prior Art

A conventional print head generally comprises a nose having plurality of print wires, solenoid bases having a plurality of cores which are arranged annularly or ovally and each of which have a solenoid bobbin, and an armature base having a plurality of armatures reciprocatably mounted thereon. An armature spring for supporting the fulcrum of each armature is mounted between the armature and the armature base.

Such a conventional print head is mounted by mounting the nose of the print head on a carriage which is slidable along a carriage rail which is mounted parallel to a platen.

The performance of the print head is affected by the length of the print wires projecting from the wire point guide mounted on the nose and the distance between the wire point ends and the platen. If the print wire point ends project too much from the wire point guide, the print wires catch in the ink ribbon.

If the print wire point ends do not project enough, the printing action is not sufficiently strong because the amount of movement of the wire is fixed.

If the distance between the wire point ends and the platen is too great, the printing becomes too light. If the distance between the wire point ends and the platen is too small, movement of the printed paper is prevented or the paper is torn.

Conventionally, distance between the wire point ends and the platen is adjusted by adjusting the position of the platen and the carriage rail relative to each other. For example, both ends of the carriage rail have an eccentric cam thereon and an adjusting lever is mounted on the eccentric cam for carrying out this adjustment.

Conventionally, the distance the print wires project from the wire point guide is adjusted by inserting spacers having various thicknesses between the nose and the solenoid base.

However, it is difficult to provide space for inserting the spaces because the mechanism overlaps the position of a flexible print circuit. Since the nose is mounted on the carriage, the distance between the wire point ends and the platen is altered by the amount of the clearance between the base portion of the carriage on which the nose is mounted and the wire point ends.

Therefore, the said distance must be adjusted every time the print head is exchanged. This distance adjustment requires a great deal of skill.

Generally, the adjustment made at the time of an exchange of the print head must be dealt with by the end user of the printer.

It is difficult for the printer user to adjust the wire points to the most preferable position, and it is also very troublesome.

A conventional print head has a heat sink which is fixed to a solenoid base and armature base by adhesive. It is difficult to disassemble and assemble. Such a print head is fixed directly to the carriage by means of the nose. Heat from the heat sink is radiated only to the atmosphere.

SUMMARY OF THE INVENTION

An object of the present invention is to provide a print head which makes it unnecessary to adjust the distance between the wire point ends and platen every time the print head is changed.

Another object of the invention is to provide a print head from which the heat of the heat sink may be radiated effectively.

Still another object of the invention is to provide a print head which may be easily adjusted.

These and other objects of the present invention will become more fully apparent to those of ordinary skill in the art from the following description and appended claims taken in conjunction with the accompanying drawings.

BRIEF DESCRIPTION OF THE DRAWINGS

FIGS. 4 and 4*b* are a plan view and a side view, respectively, of the carriage of a printer;

DETAILED DESCRIPTION OF THE PREFERRED EMBODIMENT

Figure 1:
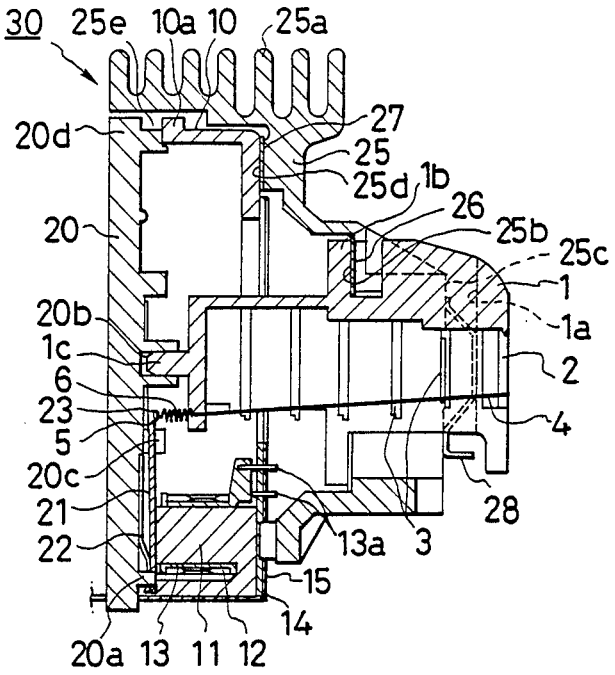
FIG. 1 is a cross section of an embodiment of the print head according to the present invention.
Figure 2:
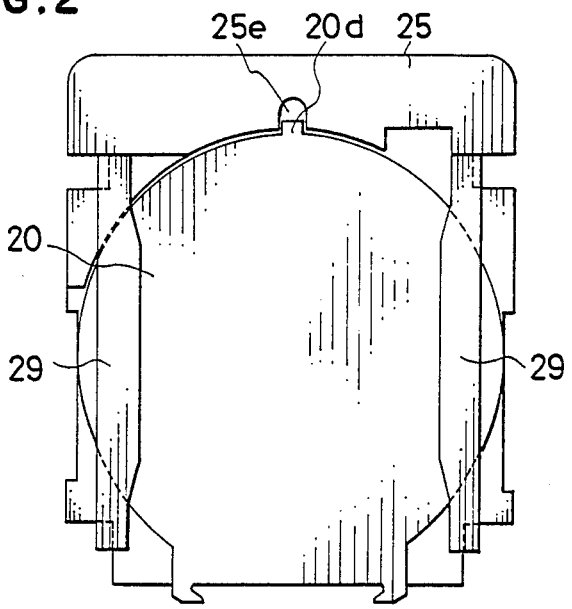
FIG. 2 is a rear elevation of the print head of FIG. 1.
Figure 3:
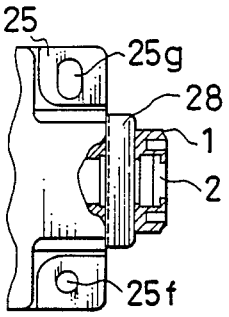
FIG. 3 is a bottom view of the front part of the print head of FIG. 1.

As shown in FIGS. 1 to 3, the wire point guide 2 having a plurality of wire middle guides 3 are mounted on the nose 1. A plurality of print wires 4 (only one is shown) are slidably guided by these wire guides 2 and 3.

The point ends of these print wires 4 are arranged in straight lines. The rear end are arranged along an oval. On the rear end of each wire 4 is fixed a wire pin 5. Each print wire 4 is pressed toward the rear end by a wire return spring 6 which is inserted between the nose 1 and the wire pin 5. On both sides of the front of the nose 1 are projections which have a leaf spring engaging surface 1*a* thereon extending perpendicularly to the wires 4. The outer side of a flange lb near the center of the nose 1 acts as a nose base contacting part. The center of the rear of the nose 1 has a projection 1*c* thereon on which an armature base 20 is mounted.

Core 11 is fixed on the bottom of a cup-shaped solenoid base 10 corresponding to the said print wires 4.

A solenoid bobbin 13 on which the solenoid 12 is wound is mounted on said core 11. On the opposite side of the solenoid base 10 from the core 11 is mounted a flexible print plate 15 with an insulator 14 insulating it from the solenoid base. Solenoid terminals 13*a* extend through holes in the insulator 14 and the flexible print plate 15, and are soldered to the flexible print circuit 15.

The solenoid bobbin 13, insulator 14 and flexible print plate 15 are thus assembled at a predetermined position on the solenoid base 10. A projection 10*a* for preventing rotation of the solenoid base 1 is formed on the periphery of the solenoid base 10.

The armature base 20 is mounted on one side of the solenoid base. This armature base 20 has a pin 20*a* at the position of the armature 21. The armature 21 is rotatably mounted on the pin 20*a*.

The armature 21 extends between said wire pin 5 and the core 11.

The center of the armature base 20 has a hole 20*b* into which the projection 1c on the nose 1 is inserted. A projection 20*c* is provided between the hole 20*b* and the pin 20*a*. This projection 20*c* is for guiding the upper end of the armature 21. The armature 21 is urged by means of the armature spring 22, which is mounted between the armature base 20 and the armature 21, in a direction for causing one side of the armature 21 to contact the solenoid base 10. The other side of the armature 21 contacts an armature stopper 23 which is fixed on the armature base 20. On the periphery of the armature base 20 is provided a projection 20*d* for preventing rotation of tee armature base 20.

A nose base 25 is provided outside of the nose 1, solenoid base 10 and armature base 20. The nose base 25 has a heat sink 25*a* thereon. A nose contacting part 25*b* is provided on the nose base 25 for contacting the nose base contacting part 1*b* through a spacer 26 for adjusting the distance the point ends of the print wires 4 project. The front 25*c* of the nose base 25 is in spaced opposed relation to the leaf spring engaging surface 1*a* at a predetermined distance. A recess 25*e* is provided in the nose base 25, and a solenoid base contacting part 25*d* contacting to the solenoid base 10 through a spacer 27 for adjusting the position of the point ends of the wires. The projections 10*a* and 20*d* for preventing the rotation of the solenoid base 10 and the armature base 20 are engaged in said recess 25*e*.

The nose 1 and nose base 25 are held together by means of a forked leaf spring 28 which is inserted between the leaf spring contacting surface 1*a* and the front 25*c* of the nose base 25. Holes 25*f* and 25*g* are formed in the nose base 25 as shown in FIG. 3 which can be fitted onto head mounting shaft 36 on carriage 35. The hole 25*g* is an elipical hole which extends in the direction of the run of the carriage 35.

Assembling of the print head comprising such members is as follows.

Print wires 4 having the wire return springs 6 thereon are mounted on the nose 1.

The solenoid base 10 having the core 11 has the solenoid bobbin 13, insulator 14 and flexible print circuit 15 mounted thereon. Then the armature 21, armature spring 22 and armature stopper 23 are mounted on the armature base 20.

The nose contacting portion 25*b* of the nose base 25 is contacted with the nose base contacting portion 1*b* through the spacer 26 for adjusting the distance the point ends of the wires project and the leaf spring 28 is inserted the clearance between the leaf spring engaging surface 1*a* of the nose 1 and the front 25*c* of the nose base 25 from below. By means of the spring action the nose base contacting portion 1*b* is pressed against the nose contacting portion 25*b* of the nose base 25 through the spacer 26. Therefore, tee nose 1 and nose base 25 are fully assembled. If the spacer 26 is exchanged, the distance the ends of the wires 4 project from the front of the wire point guide 2 is changed. The spacer 26 having most suitable thickness for the desired projection of the point ends of the wires is used.

Secondly, the spacer 27 for adjusting the position of the wire point is placed on the solenoid base contacting portion 25*d* of the nose base 25, the projection 10*a* is inserted in the recess 25*e* of the nose base 25 and the solenoid base 10 is contacted with the solenoid base contacting part 25*d* of the nose base. When the spacer 27 is exchanged for a spacer of a different thickness the distance between a line extending between the center of the holes 25*f* and 25*g* in the nose base 25 and the point ends of the wires 4 is changed. A spacer 27 having a thickness which is such as to give a predetermined distance between the line between the holes 25*f* and 25*g* and the point ends of the wires 4 is used.

The projection 1*c* on the nose 1 is inserted into the hole 20*b* of the armature base 20, the projection 20*d* is inserted into the recess 25*e* of the nose base 25, and the armature base 20 is contacted with the solenoid base 10.

Lastly, fasteners 29 are provided on the rear of the armature base 20. When both ends of the fasteners 29 are engaged with the nose base 25, the armature base 20 is pressed against the solenoid base 10 and the solenoid base 10 is pressed against the solenoid base contacting part 25*d*.

Figure 6:
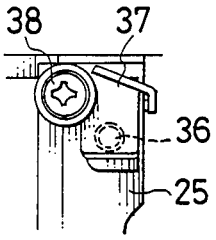
FIG. 6 is a plan view of a portion of FIG. 5.
Figure 4:
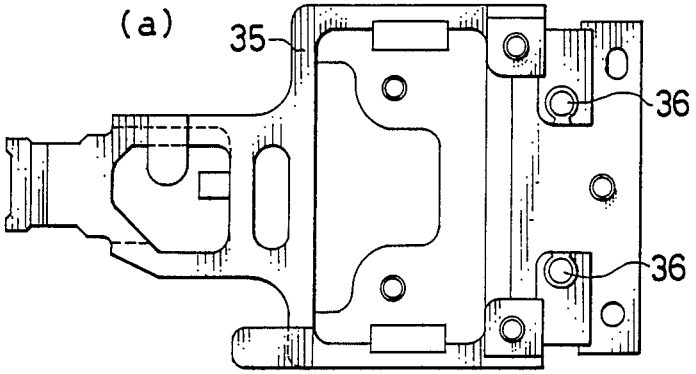
Figure 4:
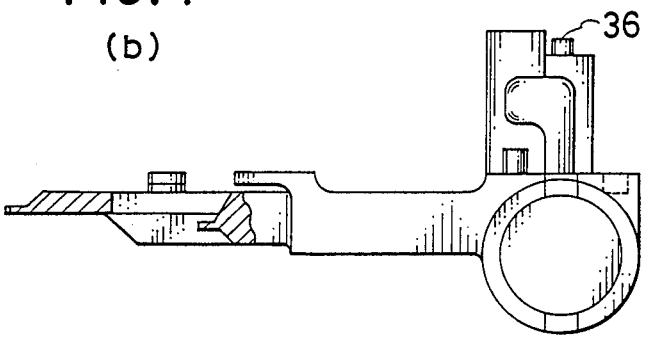
Figure 5:
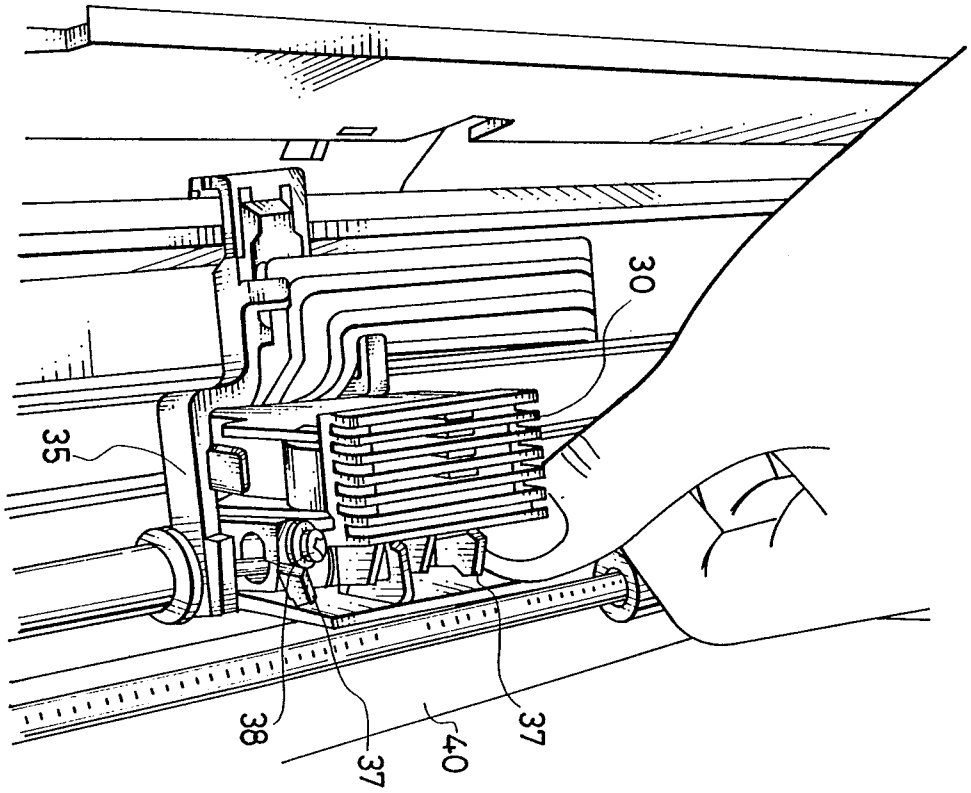
FIG. 5 is a perspective view for showing the method of fixing the print head to the carriage.

Therefore, the solenoid base 10 and armature base 20 are completely assembled with the nose base 25. As illustrated in FIGS. 4 to 6, the holes 25*f* and 25*g* of such assembled print head 30 are placed over the head mounting shafts 36 on the carriage 36 and head holders 37 are mounted on the nose base 25. Therefore, the print head 30 is fixed to the carriage 35.

The distance between the print head 30 and platen 40 is adjusted the same as for a conventional print head.

Figure 7:
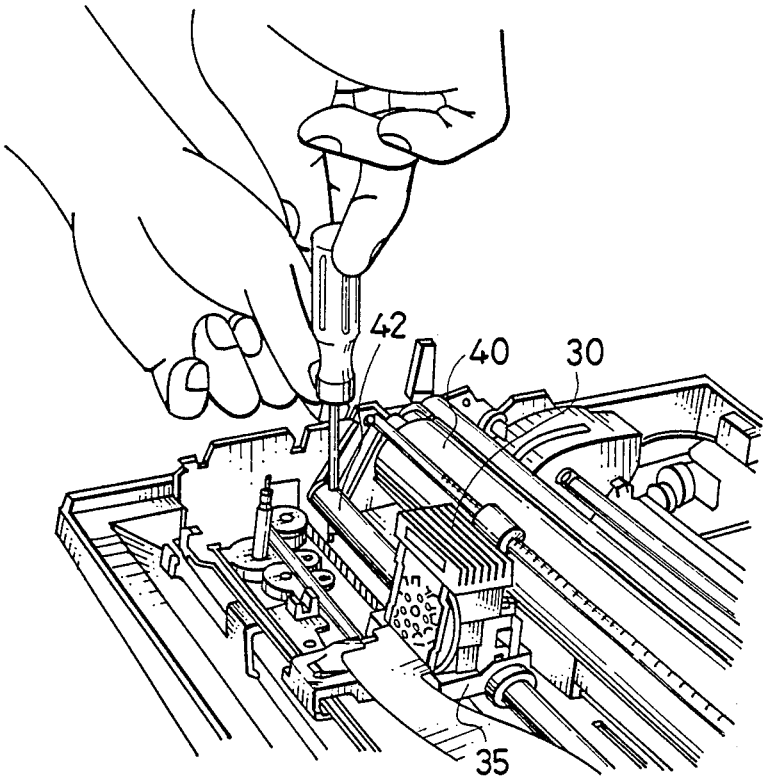
FIG. 7 and FIG. 8 are perspective views showing the operation of adjusting the distance between the platen and the print head.
Figure 8:
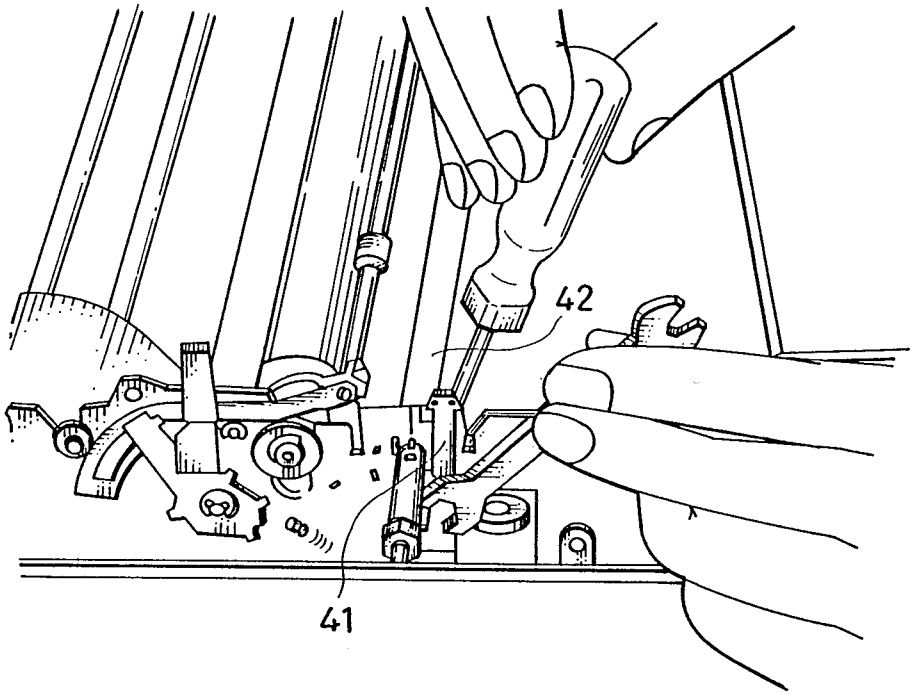

As shown in FIGS. 7 and 8, after the distance adjusting lever 41 is positioned at the standard point, the distance for the standard point of the lever 41 is adjusted by rotating on the carriage rail 42 relatively to the lever. Therefore, the distance between the platen 40 and the print wire 4 is adjusted.

In each print head 30, the distance between the line between the holes 25*f* and 25*g* of the nose base 25 and the wire ends of the wires 4 is fixed. If the distance is adjusted during assembly in the factory, the adjustments is not required even if the print head 30 is exchanged.

Therefore, any end user can exchange the print head easily.

The nose 1 is fixed to the nose base 25 having the heat sink 25*a* by the leaf spring 28 and the solenoid base 10 is fixed to the nose base 25 elastically by the fasteners 29. Therefore, these members can be disassembled or assembled easily.

Since the nose 1 is fixed to the carriage 35 through the nose base 25 the heat of the heat sink is radiated to the carriage as well as to the atmosphere.

Obviously many modifications and variations of the present invention are possible in light of the foregoing description. It is therefore to be understood that within the scope of the appended claims, the invention may be practiced otherwise than as specifically described.

What is claimed is:

1. A print head for a dot-type printer, comprising:

a nose having a wire point guide thereon and a plurality of print wires slidably guided in said wire point guide, said nose having a nose base contacting surface thereon;

a solenoid base having magnetic means for moving the respective print wires selectively for causing the point ends of the wires to move outwardly from said wire point guide for printing on paper on a platen;

a nose base having a nose contacting surface in opposed relation to said nose base contacting surface on said nose, and having a solenoid base contacting surface in opposed relation to said solenoid base and having mounting means for mounting the print head on a carriage;

a spacer engaged between said nose base contacting surface and said nose contacting surface for adjusting the distance the wire ends extend from the front of said wire point guide;

a further spacer engaged between said solenoid base and said solenoid base contacting surface for adjusting the distance of the wire ends from the carriage; and a leaf spring removably engaged between said nose and said nose base for holding said nose and said nose base together.

2. A print head as claimed in claim 1 in which said nose base further has a heat sink thereon.

3. A print head as claimed in claim 1 in which said nose has a spring engaging surface thereon and said nose base has a further spring engaging surface thereon in spaced opposed relation to said firstmentioned spring engaging surface, said leaf spring being removably engaged between said spring engaging surfaces.

* * * * *